US010451371B2

(12) United States Patent
DiChario et al.

(10) Patent No.: US 10,451,371 B2
(45) Date of Patent: Oct. 22, 2019

(54) SHOTGUN WITH DECOCKING MECHANISM

(71) Applicants: American Tactical, Inc., Summerville, SC (US); Ali ihsan Kuzu, Isparta (TR)

(72) Inventors: Anthony DiChario, Eutawville, SC (US); Joel Edwards, North Charleston, SC (US); Ali ihsan Kuzu, Isparta (TR)

(73) Assignee: American Tactical, Inc., Summerfield, SC (US)

( * ) Notice: Subject to any disclaimer, the term of this patent is extended or adjusted under 35 U.S.C. 154(b) by 0 days.

(21) Appl. No.: 16/148,635

(22) Filed: Oct. 1, 2018

(65) Prior Publication Data

US 2019/0033029 A1 Jan. 31, 2019

Related U.S. Application Data

(63) Continuation of application No. 15/794,409, filed on Oct. 26, 2017, now abandoned.

(60) Provisional application No. 62/413,218, filed on Oct. 26, 2016.

(51) Int. Cl.

| | |
|---|---|
| ***F41A 19/54*** | (2006.01) |
| ***F41A 17/46*** | (2006.01) |
| *F41A 17/74* | (2006.01) |

(52) U.S. Cl.

CPC ..... *F41A 19/54* (2013.01); *F41A 17/46* (2013.01); *F41A 17/74* (2013.01)

(58) Field of Classification Search

CPC ..... F41A 19/54; F41A 17/46; F41A 17/74; F41A 17/80; F41A 17/82; F41A 17/76

USPC ..... 42/70.06

See application file for complete search history.

(56) References Cited

U.S. PATENT DOCUMENTS

| | | | | | |
|---|---|---|---|---|---|
| 152,839 | A * | 7/1874 | Garfield | F41A 17/74 | 42/70.08 |
| 172,943 | A * | 2/1876 | Anson et al. | F41A 19/54 | 42/43 |
| 194,680 | A * | 8/1877 | Heysinger | F41A 17/74 | 42/70.08 |
| 210,436 | A * | 12/1878 | Scott et al. | F41A 19/54 | 42/43 |
| 229,383 | A * | 6/1880 | Crabtree | F41A 17/74 | 42/70.08 |
| 229,604 | A * | 7/1880 | Greener | F41A 19/54 | 42/43 |
| 239,652 | A * | 4/1881 | Fiske | F41A 17/46 | 42/70.01 |
| 320,038 | A * | 6/1885 | Altmaier | F41A 17/46 | 42/70.06 |
| 3,389,488 | A * | 6/1968 | Beretta | F41A 19/19 | 42/42.01 |
| 3,451,154 | A * | 6/1969 | Goble | F41A 17/74 | 42/51 |
| 4,962,606 | A * | 10/1990 | Pozzi | F41A 17/82 | 42/66 |

(Continued)

*Primary Examiner* — Joshua E Freeman

(74) *Attorney, Agent, or Firm* — Woods Oviatt Gilman LLP; Katherine H. McGuire, Esq.

(57) ABSTRACT

A decocking safety lever for use with an external hammer shotgun includes a safety rod selectively positionable between a safe position wherein squeezing of the trigger is prevented; a fire position wherein squeezing of the trigger fires a shotgun shell; and a decocked positioned wherein the hammer is positioned in a decocked position and unable to fire the shotgun shell.

3 Claims, 7 Drawing Sheets

(56) References Cited

U.S. PATENT DOCUMENTS

| | | | | | |
|---|---|---|---|---|---|
| 5,067,266 | A | | 11/1991 | Findlay | |
| 5,086,579 | A | * | 2/1992 | Flatley | F41A 17/74 42/69.03 |
| 5,212,327 | A | * | 5/1993 | Schuemann | F41A 17/32 42/70.01 |
| 5,267,407 | A | | 12/1993 | Bornancini | |
| 5,303,494 | A | * | 4/1994 | Tuma | F41A 17/56 42/69.03 |
| 5,465,518 | A | * | 11/1995 | Blaser | F41A 17/06 42/70.08 |
| 5,467,550 | A | * | 11/1995 | Mumbleau | F41A 17/02 42/70.11 |
| 5,596,162 | A | * | 1/1997 | Burns | F41A 19/46 84/142 |
| 5,625,971 | A | * | 5/1997 | Tuma | F41A 17/24 42/70.01 |
| 6,415,702 | B1 | * | 7/2002 | Szabo | F41A 17/28 42/70.08 |
| 6,588,136 | B2 | * | 7/2003 | Baker | F41A 19/48 42/70.02 |
| 2006/0150466 | A1 | * | 7/2006 | Hochstrate | F41A 17/72 42/69.03 |
| 2012/0023801 | A1 | * | 2/2012 | Rozum | F41A 17/00 42/70.08 |
| 2014/0020274 | A1 | * | 1/2014 | Wasmer | F41A 17/063 42/1.01 |
| 2016/0320154 | A1 | * | 11/2016 | Krieger | F41A 17/64 |

* cited by examiner

SHOTGUN WITH DECOCKING MECHANISM

This application is a continuation of U.S. application Ser. No. 15/794,409 filed on Oct. 26, 2017, and claims the benefit of U.S. Provisional Application Ser. No. 62/413,218 filed on Oct. 26, 2016, the disclosure of which is incorporated herein by reference.

FIELD OF THE INVENTION

The present invention relates to break open shotguns and more particularly to a break-open shotgun having a safety and even more particularly to a break-open shotgun having a safety selectively moveable between a full-safe position, a fire position and a decocked position.

BACKGROUND OF THE INVENTION

Typical break-open shotguns, also commonly referred to as break-action shotguns, are breech loading firearms wherein the barrel is pivoted away from the receiver when extracting and reloading new shotgun shells/cartridges. Autococking shotguns include an autococking mechanism wherein the hammer is cocked to the firing position upon breaking open of the barrel. Once new shells have been loaded, the barrel is then return pivoted to seat against the face of the receiver. A user can then fire the shotgun upon squeezing of the trigger to release the hammer whereby the hammer strikes a striking pin causing ignition of the primer and powder within the shell.

The shotgun may include a safety lever which may selectively place the shotgun in a safe condition whereby the trigger cannot be squeezed thereby preventing release of the hammer. Disengaging the safety lever places the shotgun within a fire position whereby squeezing the trigger fires the shotgun. While the safety lever may prevent unwanted firing of the shotgun, accidental firings may still occur as the hammer is maintained in a cocked position even while the safety lever is engaged. However, failure of the safety lever or disengagement of the safety lever, such as upon dropping or impacting the body of the shotgun, may cause unintentional release of the hammer and unwanted, and possibly deadly, firing of the shotgun. This hazard is further compounded within hammerless shotguns wherein the entire firing mechanism is housed within the body of the firearm. As such, a user encountering a hammerless shotgun will not be able to visually see whether the hammers are cocked or whether there are live shells within the chambers.

Thus, what is needed in the art is a safety mechanism configured to prevent unwanted discharge of the shotgun and to selectively place the hammers within a decocked position wherein dropping or impacting the shotgun body will not cause the hammers to strike the striking pin and fire the shotgun.

SUMMARY OF THE INVENTION

The present invention addresses the above need by providing in an embodiment a decocking safety lever for use with an external hammer shotgun. The shotgun includes a hammer configured to fire a loaded shotgun shell upon squeezing of a trigger. The decocking safety lever may comprise a safety rod selectively positionable between a safe position wherein squeezing of the trigger is prevented; a fire position wherein squeezing of the trigger fires the shotgun shell; and a decocked positioned wherein the hammer is positioned in a decocked position and unable to fire the shotgun shell.

DETAILED DESCRIPTION OF A PREFERRED EMBODIMENT

Figure 1:
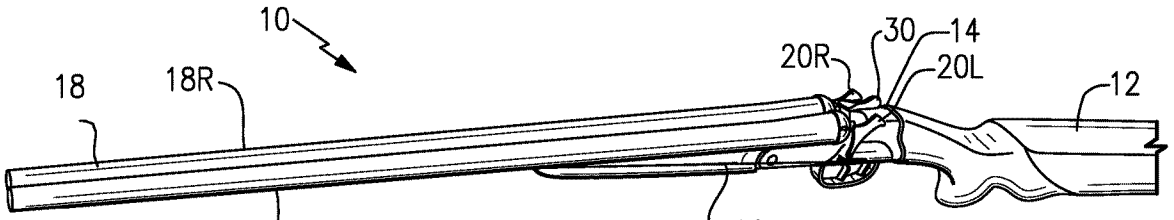
FIG. 1 is a perspective view of an external hammer double barrel shotgun configured to use a decocking safety lever in accordance with the present invention.
Figure 2:
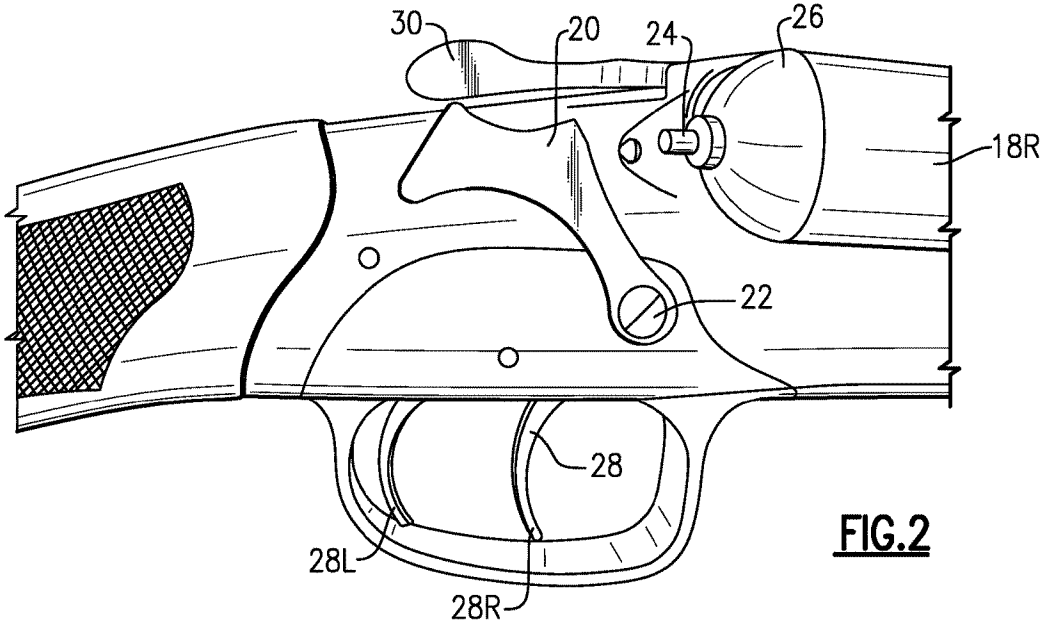
FIG. 2 is an expanded view of a receiver used with the shotgun shown in FIG. 1.
Figure 6:
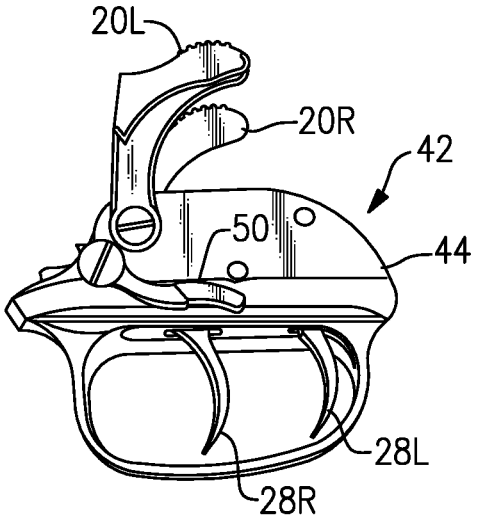
FIG. 6 is an isolated view of the trigger group shown in FIG. 5.

FIG. 1 illustrates a shotgun 10 configured to use a decocking mechanism in accordance with an embodiment of the invention. Spreader 10 includes a stock 12 coupled to a receiver 14, the receiver pivotally receiving a forearm (also commonly known as a foregrip or forend) 16 and barrel 18. As shown in FIG. 1, shotgun 10 may be a double barrel side-by-side (SXS) shotgun having a right barrel 18R and a left barrel 18L. As shown in FIGS. 1 and 6, shotgun 10 may be an external hammer double barrel shotgun having a right hammer 20R and left hammer 20L. Each hammer 20 may pivot about a respective hammer pin 22 to strike a respective firing pin 24 extending outwardly from a respective ball fence 26. As is known in the art, striking a firing pin with a hammer, such as after squeezing of a trigger 28, may cause the firing pin to ignite the primer and powder within a loaded shotgun shell housed at the breech end of the barrel, thereby causing shotgun 10 to fire. As shown in FIGS. 1 and 2, shotgun 10 may include two triggers 28, wherein front trigger 28R is configured to fire a shotgun shell out of right barrel 18R while the rear trigger 28L is configured to fire a shotgun shell out of left barrel 18L.

Figure 3:
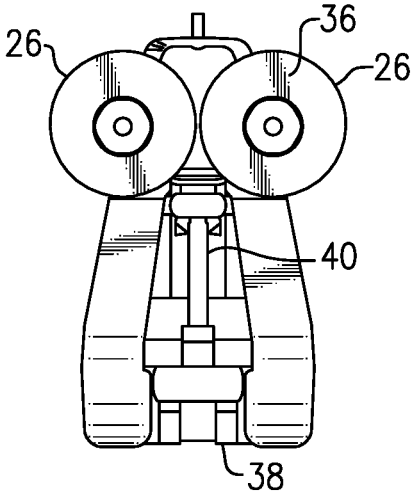
FIG. 3 is an a front end view of the receiver shown in FIG. 2.
Figure 4:
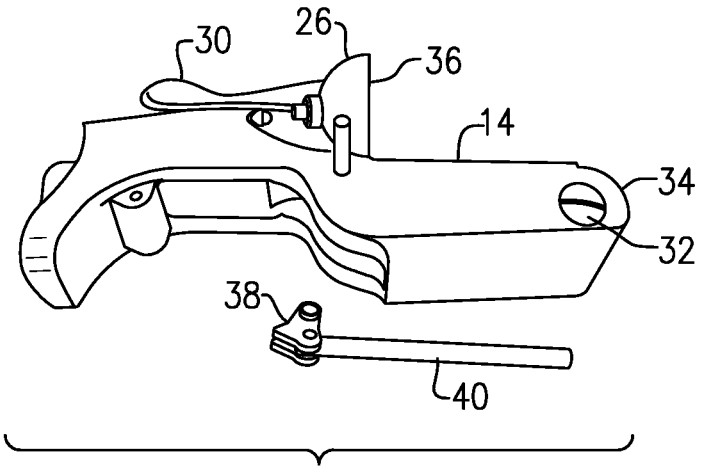
FIG. 4 is a side perspective view of the receiver shown in FIG. 3.

To expel used shell cartridges and load new cartridges, top lever 30 may be pivoted so as to allow forearm 16 and barrel 18 to be pivoted about hinge pin 32 at knuckle end 34 of receiver 14. Pivoting barrel 18 opens the breech between barrel 18 and breech face 36 of ball fence 26. Used shells may either be ejected automatically or manually pulled out and new shells may be loaded as is known in the art. Reverse pivoting forearm 16 and barrel 18 to close the breech (such as after loading new shells) causes hammers 20R, 20L to automatically recock. To that end, as shown in FIGS. 3 and 4, a cocking rod 40 may be configured to engage forearm 16 which thereby pivots a cocking cam 38, which in turn drives hammers 20R, 20L to pivot to the cocked position, ready for firing shotgun 10 upon squeezing of one or both triggers 28R, 28L, respectively.

Figure 5:
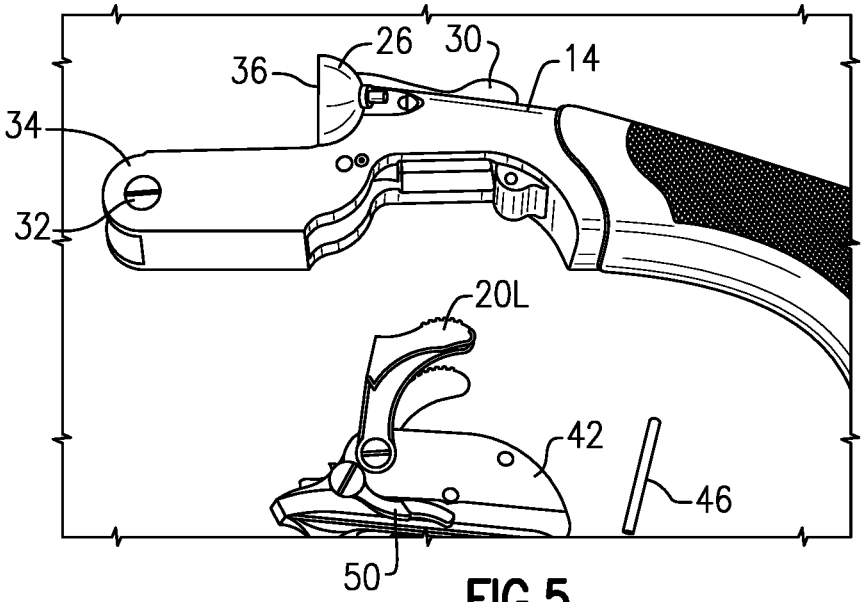
FIG. 5 is a partial exploded view of the receiver shown in FIG. 2 with the trigger group removed.
Figure 7:
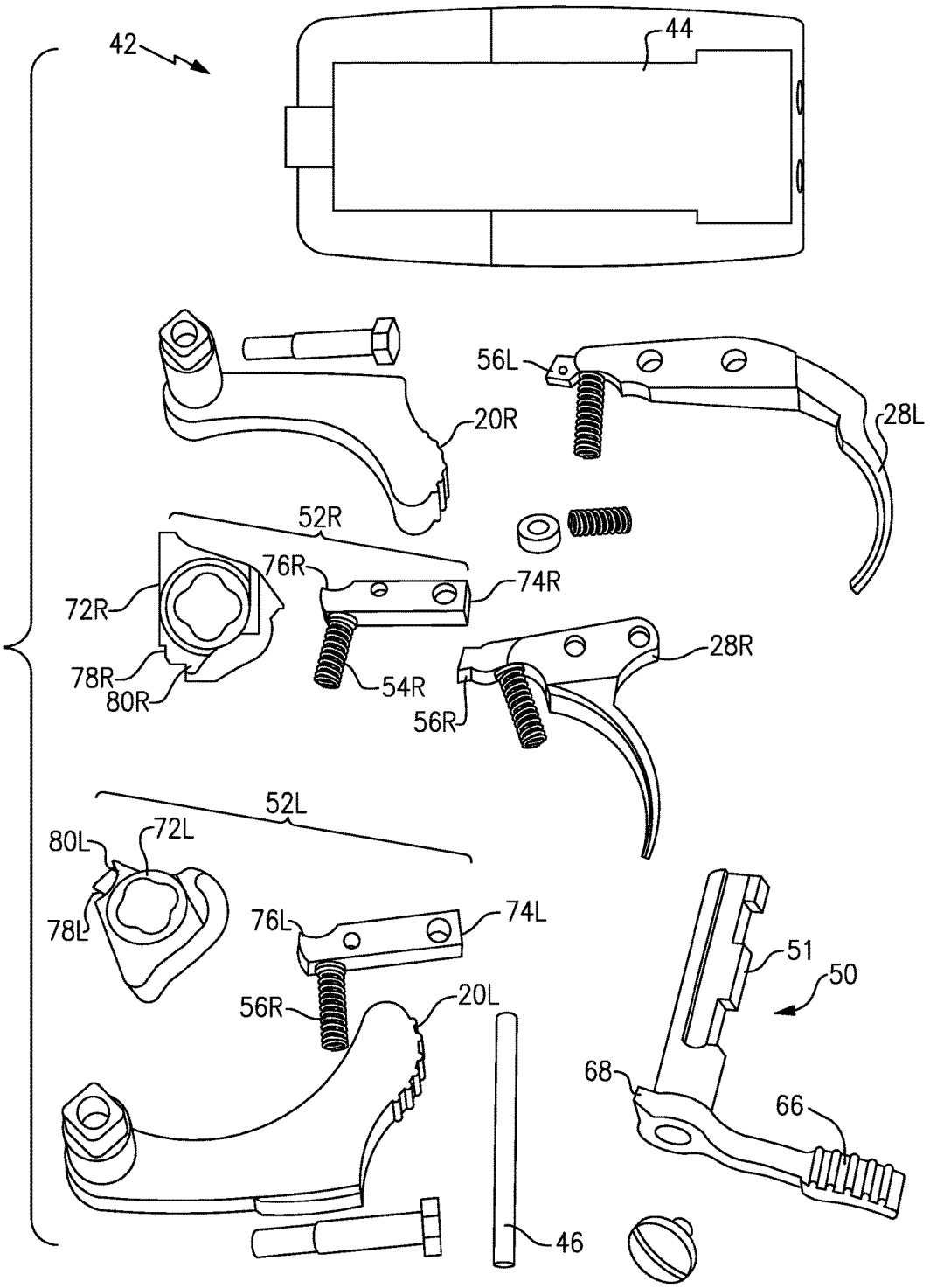
FIG. 7 is an exploded view of the trigger group shown in FIG. 6.
Figure 8:
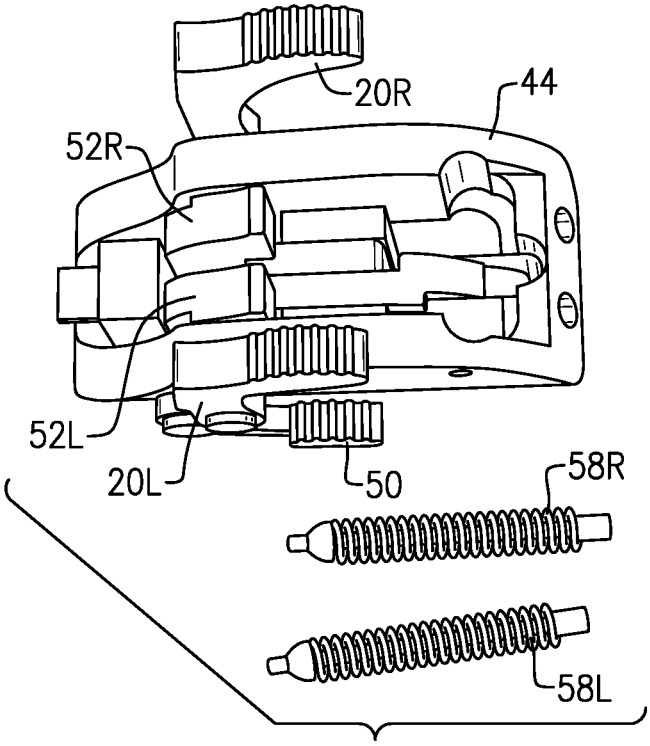
FIG. 8 is a partial exploded top view of the trigger group showing the hammer springs removed.
Figure 9:
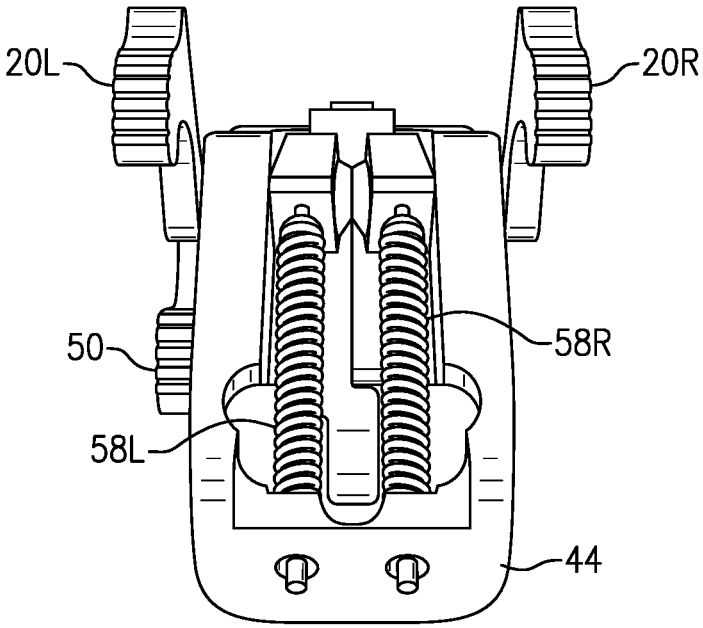
FIG. 9 is an end view of the trigger group showing the hammer springs installed.

As further shown in FIGS. 5-7, hammers 20R and 20L, along with respective triggers 28R and 28L may be mounted within a trigger group 42 having a housing 44 that is configured to be releasably coupled to receiver 14 by way of a trigger group mounting pin 46. Trigger group 42 may further include a decocking safety lever 50 which will be discussed in greater detail below. FIG. 7 shows an exploded view of the major constituents of trigger group 42. As described above, automatic cocking of hammers 20R, 20L upon reclosing the breech is driven by cocking cam 38 pivoting hammers 20R, 20L to the cocked position. Pivoting of hammers 20R, 20L further pivot respective sear assemblies 52R, 52L to a loaded position wherein a respective sear spring 54R, 54L is compressed to store potential energy therein. A pawl 56R, 56L on respective triggers 28R, 28L maintain their respective sear assemblies 52R, 52L in the loaded position. Pivoting of hammers 20R, 20L also compress and load hammer springs 58R, 58L (see FIGS. 8 and 9).

Figure 10:
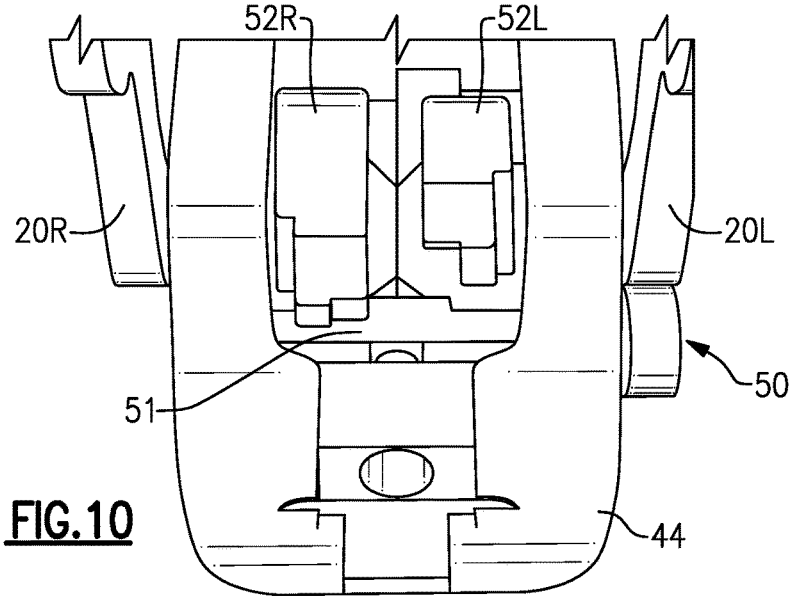
FIG. 10 is an expanded rear perspective view of the trigger group showing the decocking safety lever installed.
Figure 11:
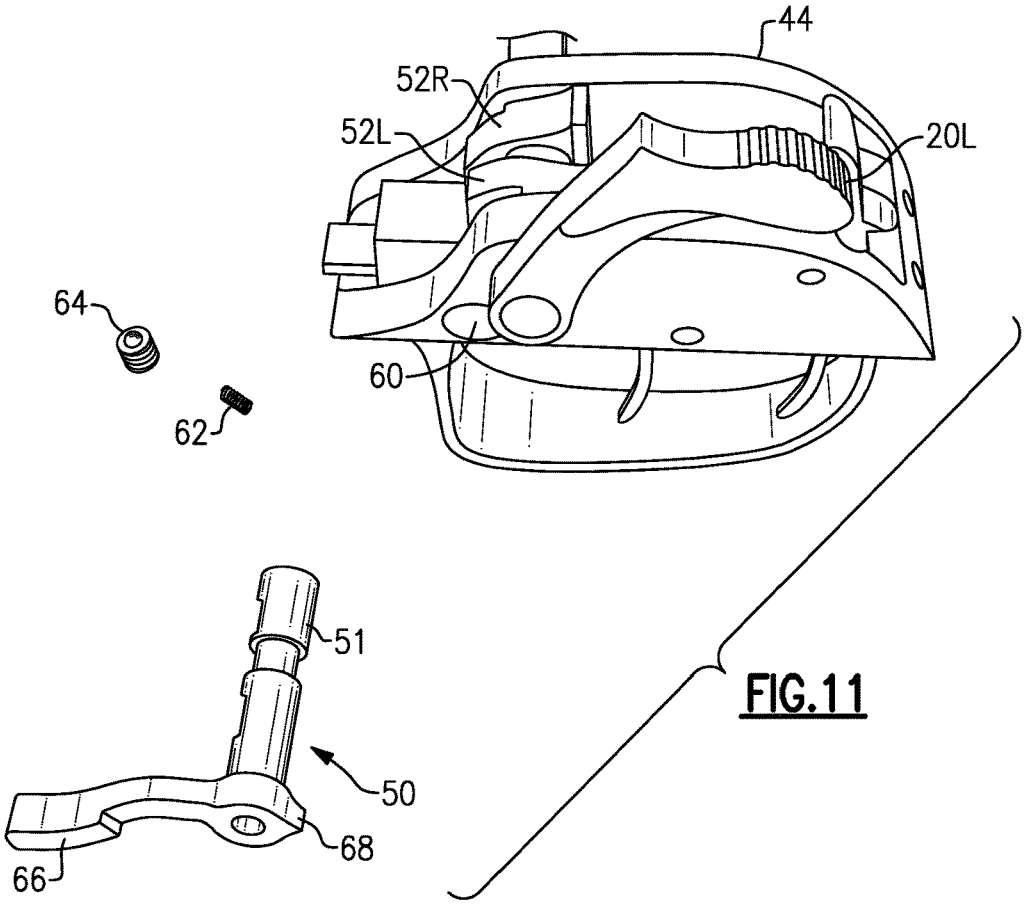
FIG. 11 is an partial exploded view of the trigger group with the decocking safety lever removed.

Release of spring potentials (i.e. sear springs 54R, 54L or hammer springs 58R, 58L) may be selectively controlled via decocking safety lever 50. As shown in FIGS. 10 and 11, decocking safety lever 50 may include a safety rod 51 configured to be received within aperture 60 defined within housing 44 and secured therein by lever spring 62 and retaining screw 64. Decocking safety lever 50 may be selectively positioned in three different positions by lever toggle 66. A spur 68 may correspond with markings 70 on receiver 14 (see FIGS. 12A-12C) to provide a visual indication of the shotgun's condition, as will described in greater detail below. As seen most clearly in FIG. 10, safety rod 51 is configured to engage cammed sears 72R, 72L of sear assemblies 52R, 52L (see FIG. 7).

Figure 12A:
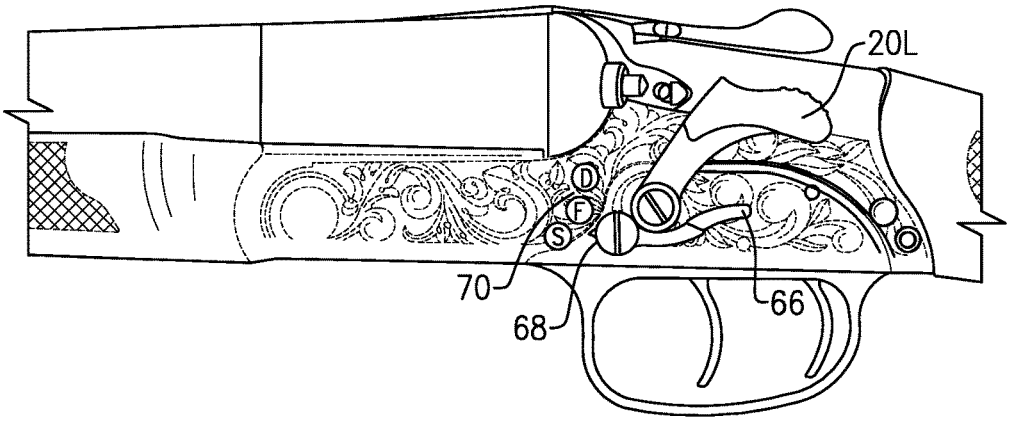
FIGS. 12A-12C show expanded side views of the shotgun with the decocking safety lever in selected positions.

With reference to FIG. 12A, with lever toggle 66 and spur 68 aligned with the "S" indication on receiver 14, shotgun 10 is in a "safe" orientation. That is, safety rod 51 engages cammed sears 72R, 72L such that squeezing of the trigger is prevented as sear assemblies 52R, 52L are inhibited from pivoting by decocking safety lever 50. This, in turn, prevents pivoting of hammers 20R, 20L so that the hammers remain in the cocked position (see FIG. 2).

Depressing lever toggle 66 and spur 68 to the "F" position as indicated on receiver 14 (FIG. 12B) places shotgun 10 in the "fire" orientation wherein squeezing of one or both triggers 28R, 28L releases the spring tension within the respective sear spring 54R, 54L and hammer spring 58R, 58L thereby driving hammer 20R, 20L to strike firing pin 24R, 24L and discharge the shotgun shell.

Figure 12B:
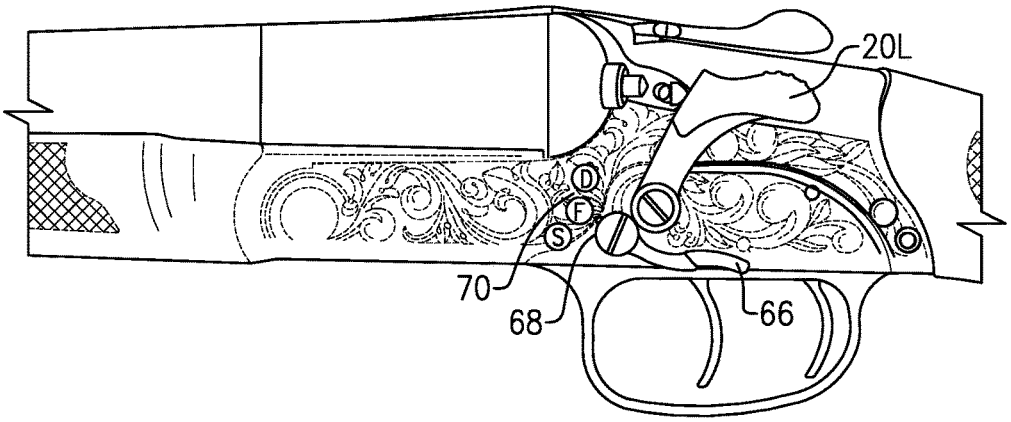
Figure 12C:
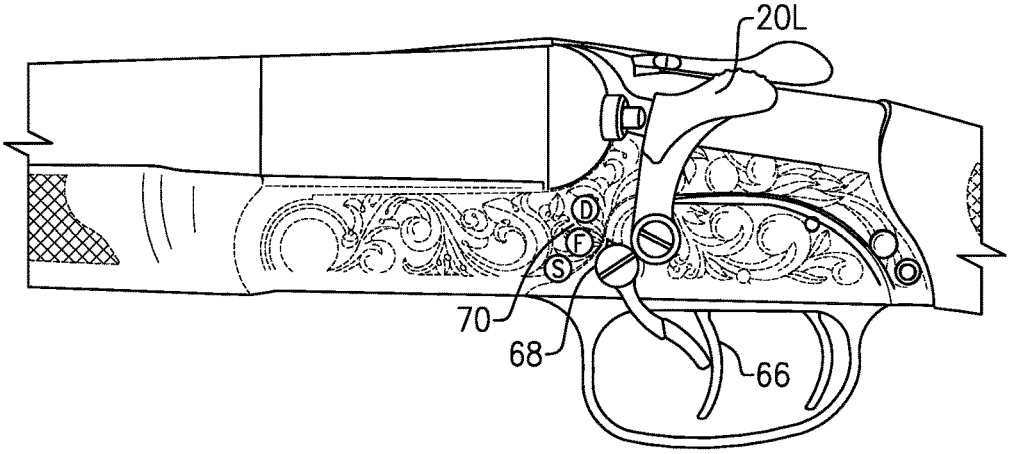

Further depressing toggle lever 66 and spur 68 to the "D" position as indicated on receiver 14 places shotgun to in the "decocked" orientation wherein safety rod 51 drives cammed sears 72R, 72L, and therefore hammers 20R, 20L to a decocked position (see FIG. 12C). When in the decocked position, hammers 20R, 20L are prevented from striking firing pins 24R, 24L even if triggers 28R, 28L are squeezed, as cammed sears 72R, 72L are prevented from any further rotation by decocking safety lever 50. To fire the shotgun, one or both hammers 20R, 20L will need to be manually pulled back to a cocked position (FIGS. 12A, 12B) and decocking safety lever 50 will need to be positioned at the "S" position as described above.

In a further aspect of the present invention and as shown in FIG. 7, each sear assembly 52R, 52L may further comprise a sear bar portion 74R, 74L including a hooked end 76R, 76L. Hooked ends 76R, 76L may be coupled to a sear notch 78R, 78L on cammed sears 72R, 72L when hammers 20R, 20L are in the cocked position (FIGS. 12A and 12B). Cammed sears 72R, 72L may further include safety notches 80R, 80L which are configured to engage hooked ends 76R, 76L when hammers 20R, 20L are released other than upon squeezing of trigger 28R, 28L. By way of example, hooked ends 76R, 76L may engage safety notches 80R, 80L upon manual decocking of the hammers or should the shotgun be dropped or the hammers be otherwise impacted while in the cocked position. Safety notches 80R, 80L prevent hammers 20R, 20L from impacting firing pins 24R, 24L such that an accidental or unwanted discharge of shotgun 10 is prevented.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A shotgun comprising:

a) a receiver pivotally mounted to a barrel configured to receive a shotgun shell therein, wherein the receiver includes an external firing pin; and b) a trigger group comprising:

i) a housing ii) an external hammer pivotally mounted on the housing;

iii) a trigger pivotally mounted to the housing, wherein squeezing of the trigger is configured to cause the external hammer to pivot from a cocked position to a fired position whereby the external hammer strikes the external firing pin to fire the shotgun shell; and iv) a decocking safety lever selectively positionable between a safe position wherein squeezing of the trigger is prevented; a fire position wherein squeezing of the trigger pivots the external hammer from the cocked position to the fired position; and a decocked position wherein the external hammer is positioned in a decocked orientation intermediate the safe position and the fire position and wherein the shotgun is unable to fire the shotgun shell.

2. The shotgun in accordance with claim 1 wherein the trigger group further comprises:

v) a sear assembly coupled to the external hammer, trigger and decocking safety lever, wherein the sear assembly includes a safety rod and a sear, wherein the safety rod may be selectively manipulated to:

A) engage the sear at a first position when the decocking safety lever is in the safe position thereby preventing squeezing of the trigger;

B) disengage from the sear when the decocking safety lever is in the fire position whereby squeezing of the trigger pivots the external hammer from the cocked position to the fired position; or C) engage the sear in a second position when the decocking safety lever is in the decocked position whereby the safety drives the sear to place the external hammer in the decocked orientation.

3. The shotgun in accordance with claim 2 wherein the sear assembly further includes a sear bar portion having a hooked end and wherein the sear defines a sear notch and a safety notch thereon, wherein the hooked end is coupled to the sear notch when the hammer is in the cocked position whereby the hooked end engages the safety notch when the hammer moves from the cocked position without squeezing of the trigger.

* * * * *